US006792956B2

(12) United States Patent
Bredo et al.

(10) Patent No.: US 6,792,956 B2
(45) Date of Patent: Sep. 21, 2004

(54) FLOATING BATHTUB OR SWIMMING POOL CLEANING DEVICE

(75) Inventors: Katia Bredo, Brussels (BE); Alejandro Cedeno, Loveland, OH (US); Nicolas Rémy Denis Pochart, Brussels (BE); Michela Ratti, Rome (IT); Joris Jozef Gustaaf Tack, Keerbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/963,820

(22) Filed: Sep. 26, 2001

(65) Prior Publication Data

US 2002/0096198 A1 Jul. 25, 2002

(51) Int. Cl.[7] ..... E04H 4/16

(52) U.S. Cl. ..... 134/22.18; 134/26; 134/10; 134/15; 134/44; 134/104.1; 134/109; 422/265; 210/91; 210/143; 210/169; 15/1.7; 15/319

(58) Field of Search ..... 134/22.18, 26, 134/10, 15, 44, 104.1, 109; 422/265; 15/1.7, 319; 210/91, 169, 143

(56) References Cited

U.S. PATENT DOCUMENTS 6,039,886 A * 3/2000 Henkin et al. ..... 210/776
6,294,084 B1 * 9/2001 Henkin et al. ..... 210/143

FOREIGN PATENT DOCUMENTS

| | | | |
|---|---|---|---|
| DE | 297 09 738 U1 | | 9/1997 |
| DE | 297 09 738 | * | 9/1997 |
| JP | 2000-93338 A | * | 4/2000 |
| WO | WO 94/23159 A1 | | 10/1994 |
| WO | WO 94/23159 | * | 10/1994 |

* cited by examiner

*Primary Examiner*—Randy Gulakowski
*Assistant Examiner*—Gentle E Winter
(74) *Attorney, Agent, or Firm*—Thibault Fayette; Jason J. Camp

(57) ABSTRACT

The present invention relates to a device (1) for cleaning a liquid-containing vessel. More particularly, the present invention relates to a device (1), suitable for cleaning liquid-containing vessels (such as bathtubs or swimming pools), equipped with an energy storage means and a self-tracking means and/or a filter, wherein said device (1) is capable of floating and actively moving in said vessel.

6 Claims, 3 Drawing Sheets

FLOATING BATHTUB OR SWIMMING POOL CLEANING DEVICE

TECHNICAL FIELD

The present invention relates to a device for cleaning a liquid-containing vessel. More particularly, the present invention relates to a device for cleaning the inner surfaces of liquid-containing vessels such as bathtubs or swimming pools, wherein said device is capable of floating and actively moving in said vessel.

BACKGROUND OF THE INVENTION

Liquid-containing vessels, preferably water-containing vessels, such as swimming pools and bathtubs, are prone to soiling. Indeed, soap-scum, limescale and other residues, such as hair and body grease, are deposited on the inner surfaces of a bathtub after use. Furthermore, the inner surfaces of swimming pools can be covered with algae, fungi and other deposits. Thus, there is a need to clean such surfaces on a frequent basis. In particular, the inner surface of a bathtub should preferably be cleaned after each use of said bathtub to avoid the build-up and/or encrustation of soap-scum, limescale, mineral deposit, mildew and other residues, such as hair and body grease, on the bathtub surface. Although, swimming pool surfaces have to be cleaned on a less frequent basis, there is nevertheless a need to clean such swimming pool surfaces at least once a month to prevent the build-up of an algae- and/or fungi-cover.

Cleaning compositions used to clean bathtubs and/or swimming pools are well known in the art. Such compositions can be either liquids, such as sprays, foams or gels, or solid, such as scouring powders. For example, WO 92/21772 describes acidic liquid detergent compositions for bathrooms. Even though, some of these cleaning compositions provide cleaning performance upon contact with the surface to be cleaned, without employing manual action, it is in most cases required that the cleaning of the inner surface of a bathtub, swimming-pool or any other vessel for liquid, requires, to at least some extent, manual action by a person cleaning said vessel.

It is well known from consumer research that the cleaning of liquid-containing vessels is a laborious and unpleasant task for the person cleaning said vessel. Indeed, to clean a bathtub, the person cleaning said bathtub has to bend over the rim of the bathtub, go on his/her knees and/or reach far into the tub to reach all parts of the bathtub with a suitable cleaning implement, as for example a sponge, cloth or brush. Furthermore, in order to clean the inner surfaces of a swimming pool, it is necessary to climb into the pool and brush the surfaces of the pool once it has been emptied. Therefore, there is a constant need for improvement in the field of cleaning the inner surfaces of a liquid-containing vessel, such as bathtubs and swimming pools.

It is therefore an objective of the present invention to provide a device for cleaning a liquid-containing vessel, such as bathtubs and swimming pools, wherein said device enables its user to clean said liquid-containing vessel in an easy and convenient manner.

It has now been found that the above objective can be met by the floating and actively moving cleaning devices according to the present invention.

An advantage of the devices as described herein is that said devices enable their user to clean said liquid-containing vessel in an easy and convenient way. Indeed, the devices herein are capable of cleaning a liquid-containing vessel autonomously, this means without any user intervention other than placing the device in said vessel and eventually starting the device.

Another advantage of the devices as described herein is that said devices can easily be used by persons of a wide range of age. Indeed, said devices can be used by children or persons that usually would not clean the inner surfaces of a liquid-containing vessel, such as bathtubs and swimming pools.

Still another advantage of the devices herein, equipped with an energy storage means, such as for example a battery, is that the need to attach the devices to the main current is eliminated, which in turn increases the safety of the devices significantly as the use of mains powered devices in and around liquid-containing vessels is affiliated with serious dangers.

A further advantage of the preferred embodiment of the present invention wherein the devices herein are used to clean a bathtub, is that the devices herein enable the person taking a bath to clean the bathtub instantly after taking the bath. By contrast, in most households a person taking a bath would otherwise simply walk away from the bathtub and leave it to the individual that is usually doing the household work to clean the bathtub. By this time the dirt and soil, as for instance soap-scum, limescale and other residues, such as hair and body grease, remaining in the bathtub after being drained may already have built-up or be encrustated, which in turn makes cleaning of the bathtub even more laborious.

BACKGROUND ART

DE 297 09 738 U describes a self-propelled, solar cell powered water-surface cleaning device.

WO 94/23159 describes a device and method for cleaning surfaces in a pool. The device is battery powered and equipped with either a propeller or a turbine and spray nozzles to apply water and/or a cleaning solution onto the pool surfaces. Furthermore, the device is equipped with brushes.

AU-A-715978 describes a swimming pool cleaning device equipped with a water-jet, spray nozzles and a filter.

JP 9-187388 describes a floating bathtub cleaning robot that is mains-powered and sprays a cleaning composition onto the bathtub surfaces. Furthermore, the robot is equipped with brushes and a propeller.

JP 2-143199 describes a floating wall surface cleaning robot equipped with two propulsion means and a sponge. In addition, the robot sprays a cleaning composition onto surfaces to be cleaned.

SUMMARY OF THE INVENTION

The present invention encompasses a device (1), suitable for cleaning liquid-containing vessels, equipped with an energy storage means and a self-tracking means, wherein said device (1) is capable of floating and actively moving in said vessel.

Furthermore, the present invention encompasses a device (1), suitable for cleaning liquid-containing vessels, equipped with an energy storage means and a filter, suitable for filtering a liquid present in said vessel, and wherein said device (1) is capable of floating and actively moving in said vessel.

Furthermore, the present invention encompasses a process of removing soil from the inner surfaces of a liquid-containing vessel, with a floating cleaning device (1)

equipped with an energy storage means, wherein said soil has been deposited on said surface less than 180 minutes prior to the start of said process.

In a preferred embodiment the devices (1) herein are used to clean bathtubs and/or swimming pools.

In another preferred embodiment according to the present invention, the liquid in the liquid-containing vessel comprises water.

In still another embodiment according to the present invention, the devices (1) herein are automatic cleaning devices.

In yet another preferred embodiment herein, said devices (1) additionally comprise a feature selected from the group consisting of: a reservoir for a cleaning composition, a pumping means (10), a motor, a rudder (7), and a spray nozzle (2), and combinations thereof.

BRIEF DESCRIPTION OF THE DRAWINGS

Whilst the specification concludes with claims which particularly point out and distinctly define the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
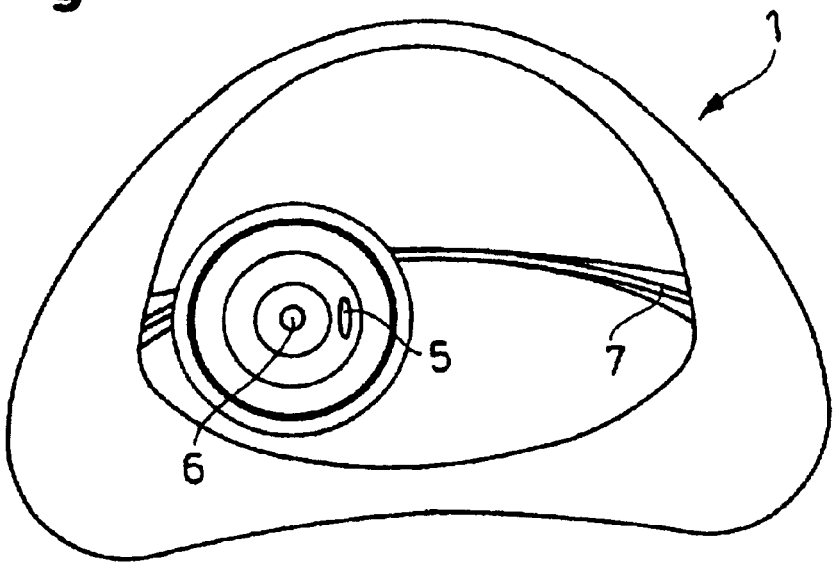
FIG. 1 is an outside bottom-view of a floating and actively moving device (1), suitable for cleaning liquid-containing vessels, according to the present invention.
Figure 2:
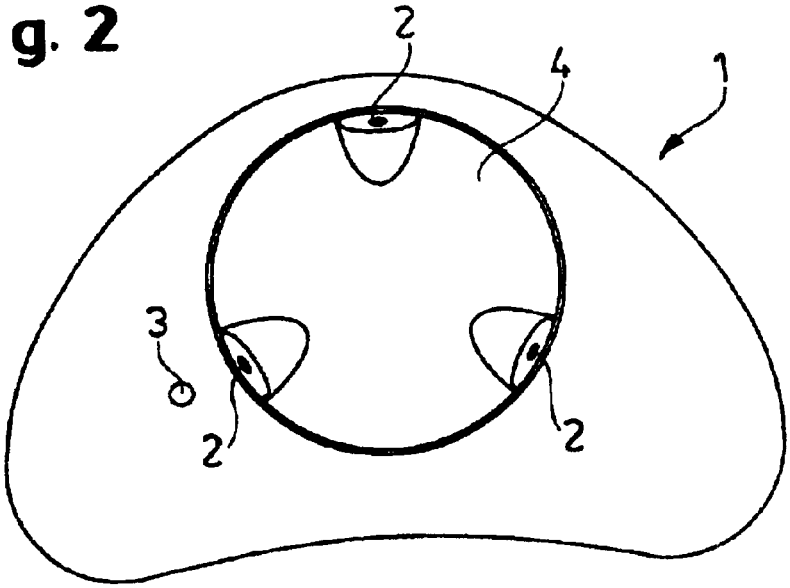
FIG. 2 is an outside top-view of a floating and actively moving device (1), suitable for cleaning liquid-containing vessels, according to the present invention.
Figure 3:
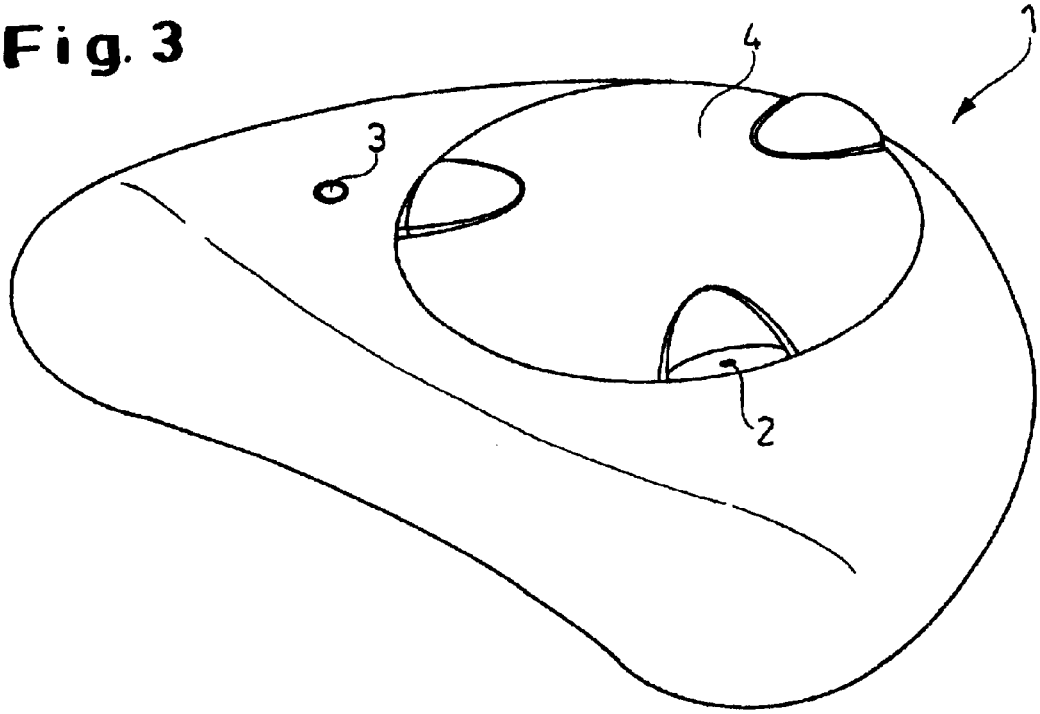
FIG. 3 is a perspective outside top-view of a floating and actively moving device (1), suitable for cleaning liquid-containing vessels, according to the present invention.
Figure 4:
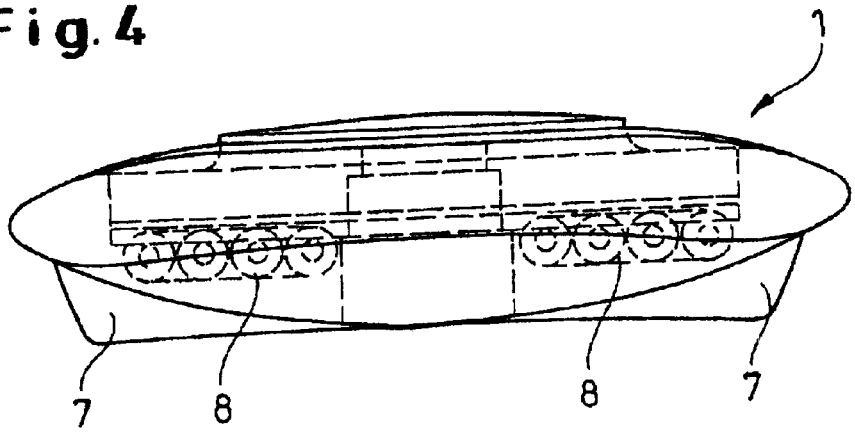
FIG. 4 is a schematic, transparent front-view of a floating and actively moving device (1), suitable for cleaning liquid-containing vessels, according to the present invention.
Figure 5:
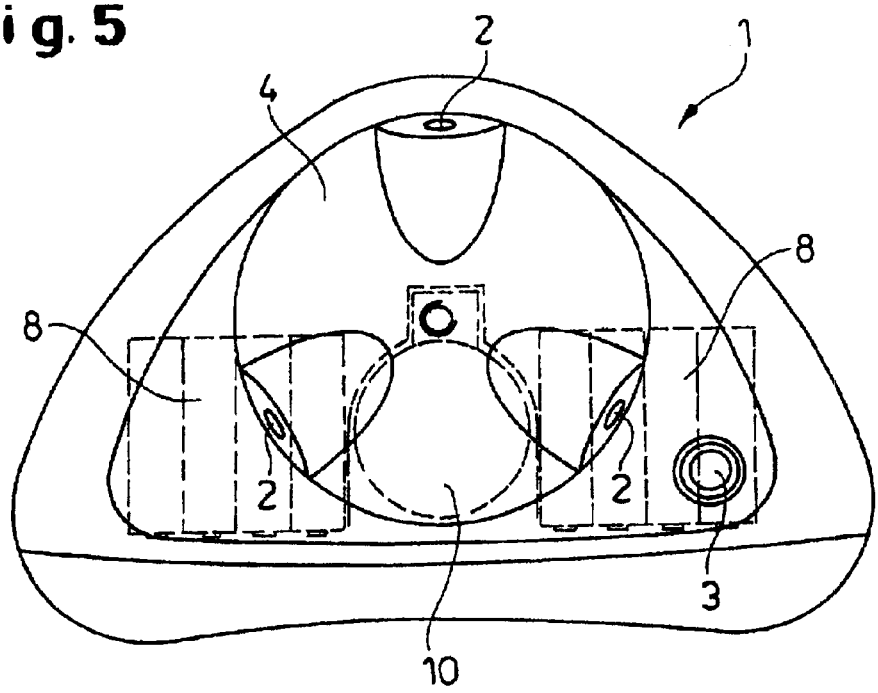
FIG. 5 is a schematic, transparent top-view of a floating and actively moving device (1), suitable for cleaning liquid-containing vessels, according to the present invention.
Figure 6:
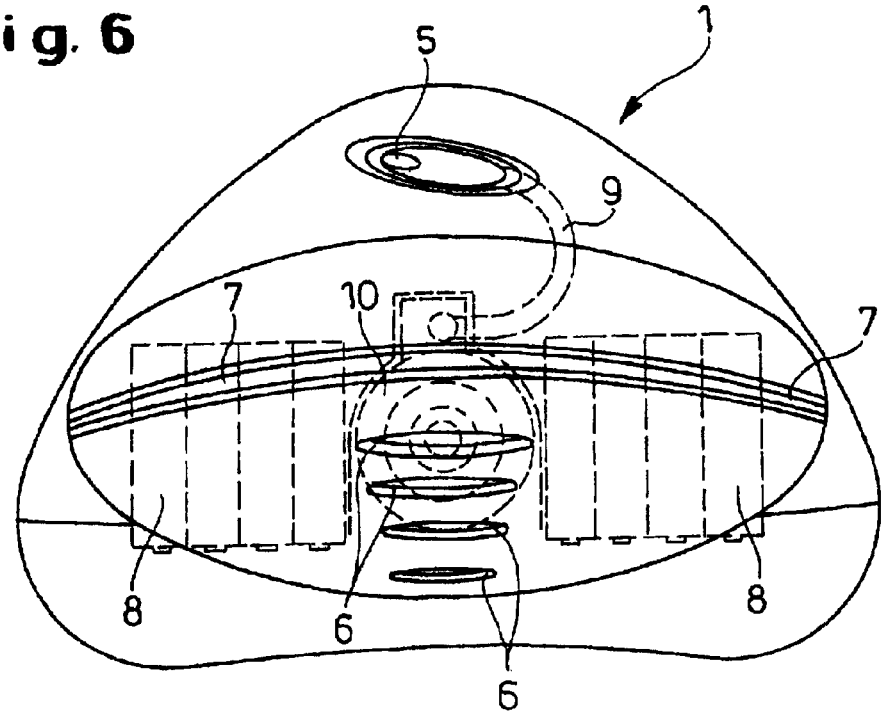
FIG. 6 is a schematic, transparent bottom-view of a floating and actively moving device (1), suitable for cleaning liquid-containing vessels, according to the present invention.

The present invention encompasses a floating and actively moving liquid-containing vessel cleaning device (1).

By "liquid-containing vessel" it is meant herein, any container capable of holding a liquid, preferably water. Preferably, said liquid-containing vessel holds more than 0.05 $m^3$ of liquid, more preferably more than 0.1 $m^3$, even more preferably more than 0.2 $m^3$, and most preferably more than 0.5 $m^3$. The liquid-containing vessels herein may be any container for liquids known to those skilled in the art. Preferably, the liquid-containing vessels herein are selected from the group consisting of bathtubs, pools, in particular swimming pools, reactors, liquid storage tanks, aquarium tanks, chemical processing equipment, fuel tanks, and the like. More preferably, the liquid-containing vessels herein are selected from the group consisting of bathtubs and swimming pools. Most preferably, the liquid-containing vessel herein is a bathtub. The liquid-containing vessel herein may hold any kind of liquid. Preferably, the liquid in said liquid-containing vessel is water, fuel, a wash solution, and the like. In a preferred embodiment wherein the liquid-containing vessel herein is a bathtub, the liquid herein comprises water and optionally a personal cleansing composition or shampoo. Furthermore, the liquid may comprise hair, body grease, soap-scum and the like dissolved and/or dispersed therein.

By "liquid-containing" it is meant herein, that at the beginning of the cleaning at least some liquid is present in the liquid-containing vessel described herein above. Preferably, at the beginning of the cleaning process herein the liquid-containing vessel is filled with at least 10%, preferably at least 25%, more preferably at least 50%, even more preferably at least 60%, and most preferably at least 75%, of its total capacity of liquid. During the cleaning with the device (1) as described herein the level of liquid in the liquid-containing vessel may increase, decrease or remain essentially constant.

The devices (1) according to the present invention may be used in a process of cleaning the inner surfaces of a liquid-containing vessel, wherein said process is performed by said devices (1) and comprises the steps of applying a cleaning composition onto the inner surfaces of said liquid-containing vessel and/or rinsing the inner surfaces of said liquid-containing vessel. Preferably, the inner surfaces of the vessel herein are rinsed with liquid present in the vessel, and wherein more preferably, the liquid is filtered before used to rinse said inner surfaces. Preferably, the step of applying a cleaning composition onto the inner surfaces of said liquid-containing vessel is performed before the step of rinsing the inner surfaces of said liquid-containing vessel. In a preferred embodiment, further steps may be performed before, in between and/or after any of the two steps of the process as described herein.

Alternatively, the steps of applying a cleaning composition onto the inner surfaces of said liquid-containing vessel and rinsing the inner surfaces of said liquid-containing vessel may be repeated for several times.

The steps in the process according to the present invention are performed by the devices (1) according to the different embodiments of present invention, in particular, the step of applying a cleaning composition onto the inner surfaces of said liquid-containing vessel and/or the step of rinsing the inner surfaces of said liquid-containing vessel are performed by the device (1) described herein.

The present invention furthermore encompasses a process of removing soil from the inner surfaces of a liquid-containing vessel, with a floating cleaning device (1) equipped with an energy storage means, wherein said soil has been deposited on said surface less than 180 minutes prior to the start of said process.

Preferably, said soil has been deposited on said surface less than, with increasing preference in the order given, 150, 120, 90, 60, 50, 45, 40, 35, 30, 20 or 15 minutes prior to the start of said process.

The Applicant has now found that by removing soil, as for example soap-scum, limescale and other residues, such as hair and body grease, from the inner surfaces of a liquid-containing vessel that is still fresh, this means soil that has been deposited on said surface less than 180 minutes prior to the start of said process ("fresh soil"), it is possible to avoid a build-up or the encrusting of said soil. Indeed, the removal of fresh soil is much easier as compared to the removal of built-up and/or encrustated soil.

In a preferred embodiment of the present invention, the liquid-containing vessel is at least partially filled with liquid and the level of liquid in the liquid-containing vessel decreases during the cleaning of the liquid-containing vessel as described herein. Preferably, the liquid-containing vessel is cleaned during the process of emptying said liquid-containing vessel. More preferably, at the end of the cleaning as described herein, the liquid-containing vessel is essentially completely drained, most preferably completely drained, of the liquid. By "essentially completely drained" it is meant herein, that the vessel holds less than 5%, preferably less than 1%, of its total capacity of liquid.

By "inner surfaces of the vessel" it is meant herein, the surfaces of the vessel that may be exposed to the liquid present in said vessel. For example, in the preferred embodiment wherein the vessel herein is a pool, the walls and the floor of said pool, or in the preferred embodiment wherein the vessel herein is a bathtub the vertical, horizontal and curved surfaces found in bathtubs. Said inner surfaces of the vessel herein may be made of any kind of material known to those skilled in the art. Preferably, said surfaces are: ceramic surfaces; enamel surfaces; glazed tiles; vinyl surfaces; no-wax vinyl surfaces; linoleum; melamine; glass; any plastics; plastified wood surfaces; metal surfaces such as steel, stainless steel, chromed surfaces; or any painted or varnished or sealed surface and the like.

Water-containing Vessel Cleaning Device

The devices (1) according to the different embodiments of the present invention are equipped with an energy storage means. By "energy storage means" it is meant herein any means known to those skilled in the art to store energy. The energy to be stored in said energy storage means may be electric energy, therefore said means may be a disposable battery or a rechargeable battery pack (8), such as an accumulator. Alternatively, the energy to be stored in said energy storage means may be kinetic energy, therefore said means may be a mechanical clockwork equipped with a spring and/or a gear. Said energy storage means may act as a power source for the devices (1) herein.

Preferably, the devices (1) according to the different embodiments of the present invention are battery powered and are more preferably equipped with a disposable battery or a rechargeable battery pack (8).

The devices (1) according to the different embodiments of the present invention are capable of actively moving in said vessel.

By "actively moving" it is meant herein, that the movement of the device (1) in the liquid-containing vessel is substantially caused by the device (1) itself and not by any outside force such as currents of the liquid present in the vessel or by manual interaction, as for example pushing or pulling, by the user of the device (1).

The devices (1) according to the different embodiments of the present invention may be equipped with a means to actively move the devices (1) in the liquid-containing vessel. By "means to actively move the device" it is meant herein any means known to those skilled in the art to capable of moving said device (1) in the liquid-containing vessel, this means, the devices (1) herein are self-propelled.

Any means to actively move the devices (1) according to the different embodiments of the present invention in said vessel may be used herein. Suitable, means to actively move the device (1) in said vessel are, for example, turbines, water-jets, propellers, and the like.

Preferably, said means capable to actively move the device (1) in said vessel is a water-jet, wherein a directed stream of liquid, discharged through a nozzle or a set thereof ("jet-nozzle"), is used to move the device (1) in the vessel. The jet-nozzle (5) or set thereof is preferably located in the portion of the device (1) that is immersed in the liquid, this means in the part of the device (1) facing the surface of the liquid or on the side of the device (1). The jet-nozzle (5) or the set thereof preferably point in the direction opposite to the direction in which the device (1) will move when the spray of liquid is discharged through the jet-nozzle (5) or set thereof. The stream of liquid may either be discharged on a constant level or may be a series of discharges.

The liquid to be discharged through the jet-nozzle (5) is preferably the liquid present in the liquid-containing vessel. The liquid to be discharged is preferably taken up through the inlet (6) as described herein below. Preferably, said inlet (6) is combined with, more preferably covered by, a filter allowing the filtration of the liquid before being discharged through the jet-nozzle (5) or set thereof.

The inlet (6) may either be an inlet with the sole purpose of providing the liquid to be discharged through the jet-nozzle (5) or may be the same inlet as described herein below to provide the rinse-liquid. The filtration may be performed by a filter as described herein below.

The stream of liquid to be discharged through the jet-nozzle (5) or set thereof is preferably created using a pumping means (10) that is present in said device (1). This pumping means may be the same pumping means as described herein below used to spray the cleaning composition onto the inner surfaces of said liquid-containing vessel and/or rinse the inner surfaces of said liquid-containing vessel or may be an additional pumping means with the sole purpose of providing the stream of liquid to be discharged through the jet-nozzle (5).

In the preferred embodiment herein, wherein the liquid-containing vessel is being emptied or drained during the process according to the present invention, the active movement stops as soon as the vessel is essentially completely drained of the liquid. Preferably, prior to the stopping of the movement of the device (1) herein, the device (1) steers or is steered to the center of the liquid-containing vessel to be cleaned.

The devices (1) according to the different embodiments of the present invention are floating devices (1).

By "floating" it is meant herein, that the devices (1) herein remain at least partially above the surface level of the liquid present in the vessel to be cleaned.

In order for the floating device (1) to be floating, it has a lower specific weight than the liquid present in the vessel, allowing the device (1) to float on the surface of said liquid. The device (1) may be partially immersed into the liquid, whereby certain parts of the device (1) are under the surface-level of the liquid, as for example, the filter, and the means to move the device, such as a jet-nozzle (5) or a set thereof, when present. Other parts of the device (1) are above the surface-level of the liquid, as for example, the spray nozzles (2), when present. The floating characteristics of the floating device (1) herein may be adjusted by balancing the weight distribution in the device (1) accordingly. For example, the relative heavy battery pack (8) may be located in that part of the device (1) that is immersed into the liquid, this means is located under the surface-level of the liquid. Furthermore, the device (1) may be equipped with a floating chamber. Preferably, said floating chamber is filled with air or any other compound that has a lower specific weight than water and is preferably located in a part of the device (1) that is located above the surface-level of the liquid.

The floating devices (1) according to the different embodiments of the present invention herein are placed on the surface of the liquid in the liquid-containing vessel herein and actively move in said vessel, preferably they actively move along the side walls of the vessel.

The devices (1) according to the different embodiments of the present invention are used to clean water-containing vessels and are preferably designed as automatic cleaning devices (1). By "automatic cleaning device" it is meant herein, devices (1), such as robots, that are capable of cleaning a water-containing vessel.

In a preferred embodiment herein, said automatic cleaning device (1) cleans the vessel herein in an autonomous way, once said device (1) is started or put into action by the user of said device ("switched on"). Indeed, after the automatic cleaning device (1) according to the present invention is switched on and/or placed into the water-containing vessel, it is capable of performing the steps of the process according to the present invention without further intervention by its user. Preferably, the automatic cleaning device (1) herein is programmed and/or constructed to perform the steps of the process herein. The set of instructions to perform the steps of the process herein may be provided in any form known to those skilled in the art, preferably programmed in a single microprocessor or set thereof, preferably present in said device (1).

Alternatively, the devices according to the different embodiments of the present invention herein may be remote controlled by its user with a radio operated controlling device or with a controlling device that is connected to the automatic device herein via a cable connection.

In a highly preferred embodiment herein, the devices (1) according to the different embodiments of the present invention will switch on by themselves without the requirement of an intervention of the user other than placing the devices (1) into the liquid-containing vessel. Preferably, the devices (1) herein are equipped with a means to detect when they are placed into the liquid-containing vessel. A suitable means to detect when they are placed into the liquid-containing vessel may be a water sensor.

Alternatively, the devices (1) according to the different embodiments of the present invention may be equipped with a means for its user to switch said devices (1) on or off. Suitable means to switch said devices (1) on or off by the user are push button switches, or any other electrical switches known to those skilled in the art.

The Applicant has now found that by using a device (1) that is equipped with a energy storage means to perform the steps of cleaning the inner surfaces of a liquid-containing vessel as described herein, the need to attach said device (1) to the main current is eliminated, which in turn increases the safety of the device (1) significantly as the use of mains powered devices (1) in and around liquid-containing vessels is affiliated with serious dangers. Indeed, if the electric circuits in a mains powered device (1) come into direct contact with liquids, preferably water, and in turn the user or persons standing close-by the vessel to be cleaned can be seriously hurt or even killed by an electrical stroke.

Furthermore, the devices (1) herein provide an easy and convenient way of cleaning liquid-containing vessels. Indeed, said devices (1) can be used by children or persons that usually would not clean liquid-containing vessels, such as bathtubs and swimming pools. Furthermore, in the preferred embodiment of the present invention wherein the liquid-containing vessel is a bathtub, the devices (1) herein enable the person taking a bath to clean the bathtub instantly after taking the bath. By contrast, in most households said person taking a bath would otherwise simply walk away from the bathtub and leave it to the individual that is usually doing the household work to clean the bathtub. By this time the dirt and soil, as for instance soap-scum, limescale and other residues, such as hair and body grease, remaining in the bathtub after being drained may already have built-up or be encrustated, which in turn makes cleaning of the bathtub even more laborious.

Furthermore, the devices (1) herein are advantageous due to the fact that they are capable of cleaning a liquid-containing vessel autonomously, this means without a user intervention other than placing the device (1) in said vessel and eventually starting the device (1).

Self Tracking Device

The present invention in a first embodiment encompasses a device (1), suitable for cleaning liquid-containing vessels, equipped with a self-tracking means.

By "self-tracking means" it is meant herein a means that allows a directed movement of the device (1) herein as compared to a random movement.

In a highly preferred embodiment herein the device (1) according to the present invention, moves along the inner sidewalls of the vessel to be cleaned. Even more preferably, the device (1) herein moves along the inner side walls of the vessel to be cleaned during the emptying of said vessel, prior to the substantially complete drainage the vessel moves to the center of the vessel and subsequently stops its movement in the center of the vessel. Preferably, the self-tracking devices herein are equipped with a steering sensor, such as infra-red proximity sensors, in order to locate the center of the vessel.

Suitable self tracking means herein may be selected from: the combination of a means to actively move the device (1) and a rudder (7) attached to the device; the combination of a means to actively move the device and balancing the center of gravity of the device (1) in the region of the device (1) that remains in contact with inner side walls of the vessel; the combination of a means to actively move the device and balancing the center of gravity of the device (1) in the vicinity of said means to actively move the device; and the combination of a means to actively move the device and a spray nozzle (2), spraying a cleaning solution and/or a rinse liquid onto the inner side walls of the vessel; and combinations thereof.

The self-tracking device (1) herein may additionally be equipped with a filter, as described herein below.

Cleaning Device Equipped with a Filter

The present invention in a second embodiment encompasses a device (1), suitable for cleaning liquid-containing vessels, equipped with a filter. Preferably, said filter is suitable for filtering a liquid present in said vessel into a rinse-liquid for said vessel and/or a liquid to be discharged through a jet-nozzle (5) or set thereof, when present.

Suitable filters for use herein may be expanded thermally bonded polymer fibres such as polypropylene (PP), polyethylene terephthalate (PET), or cellulosic material or combinations thereof. The use of a filter prevents that particles present in the liquid, such as hair, leafs, solid residues and the like, can enter the device (1) and in turn reduce the performance and/or the operation reliability of the pump, when present, or the spray nozzles (2), when present, or even jam up the pump, when present, or the spray nozzles (2), when present.

Said filter may preferably be combined with, more preferably cover, a liquid inlet (6), when present in the device (1) herein. In a preferred embodiment here, the liquid present in the vessel to be cleaned is pumped or taken up from the vessel to be cleaned through an inlet (6) covered by a filter. By "inlet" it is meant herein, an opening for intake of liquid. In a preferred embodiment herein, the liquid is pumped or taken up from the vessel to be cleaned through an inlet (6) covered by a filter.

Optional Components of the Devices Herein

The cleaning devices (1) according to the different embodiments of the present invention herein may additionally be equipped with or comprise a number of other optional components other than the ones described herein above.

The cleaning devices (1) according to the different embodiments of the present invention herein may additionally be equipped with a rudder (7). By "rudder" it is meant herein, a wing or fin allowing to stabilize and/or steer the movement of the floating device (1) herein. Said rudder (7) may either be fixed or variable, in order to achieve the desired steering and/or stabilization of the movement.

In order to be able to apply a cleaning composition onto the inner surfaces of the liquid-containing vessel herein and/or to rinse the inner surfaces of said liquid-containing vessel, the device (1) herein may be equipped with a spray nozzle (2) or a set of spray nozzles. Each spray nozzle (2) herein has at least one aperture through which liquids, as for example the cleaning composition, can be dispensed or discharged. The spray nozzle (2) or set of spray nozzles herein are preferably located on the automatic cleaning device (1) in a way that allow the application of liquids targeted onto the inner-surface to be most efficient.

Furthermore, it is preferred herein, that the spray nozzle (2) or set of spray nozzles as described herein above are located in the portion of the device (1) that is not immersed in the liquid, this means in the part of the device (1) not facing the surface of the liquid or on the side of the device (1).

The liquid to be dispensed through the spray nozzle (2) or set of spray nozzles to rinse the inner surfaces of the vessels herein is preferably the liquid present in the liquid-containing vessel and the device (1) herein may therefore further be equipped with an inlet for the liquid. Preferably, said inlet is combined with, more preferably covered by, a filter allowing the filtration of the liquid before being dispensed through the spray nozzle (2) or set of spray nozzles.

The inlet may either be the same inlet (6) as described herein above to provide the liquid to be discharged through the jet-nozzles (5), when present, or may be an additional inlet with the sole purpose of providing the rinsing liquid. The filtration may either be performed by the filter as described herein above for the filtration of the liquid to be discharged through the jet-nozzles (5), when present, or may be an additional filter with the sole purpose of filtration of the rinsing liquid.

In a preferred embodiment herein, the devices (1) according to the different embodiments of the present invention herein are equipped with a set of spray nozzles (2), preferably two or more spray nozzles (2), and more preferably three spray nozzles (2). More preferably, said devices (1) are equipped with a set of spray nozzles (2) mounted onto a rotating spray head (4). By "rotating spray head" it is meant herein, a circular shaped support for the set of spray nozzles (2) that is capable of rotating around its axis and therefore allows for the better distribution of the cleaning composition dispensed by the set of spray nozzles (2) and/or the liquid used to rinse the inner surfaces of said liquid-containing vessel. Preferably, said rotating spray head (4) may start and/or stop rotating during the process of cleaning a liquid-containing vessel described herein. Indeed, said rotating spray head (4) may be fixed during certain steps of the process of cleaning herein. By fixing said rotating spray head (4) during certain steps of the process of cleaning herein, a more efficient and directed spraying from fixed spray nozzles (2) onto the inner surfaces of the vessel to be cleaned can be achieved.

The devices (1) according to the different embodiments of the present invention herein may be equipped with a pumping means (10) that allows to pump the cleaning composition herein and/or the liquid used to rinse the inner surface of the vessel herein. The pumping means (10) herein is preferably an electrically operated pump. The electrically operated pump may be, for example, a gear pump, an impeller pump, a piston pump, a centrifugal pump, a screw pump, a peristaltic pump, a diaphragm pump, or any other miniature pump. In a highly preferred embodiment the electrically driven pump for use herein is a centrifugal pump or impeller pump with a typical flow-rate of from 100 $ml*min^{-1}$ to 5000 $ml*min^{-1}$, preferably from 2000 $ml*min^{-1}$ to 3000 $ml*min^{-1}$ and preferably operating at a pressure of from 500 mbar to 1000 mbar. The electrically driven pump is driven by an electric motor, which typically produces a torque of between 1 and 75 mN*m, preferably 1 and 50 mN*m.

The electric motor, when present, must in turn be provided with a power source. The power source may be the energy storage means as described herein above. In case said energy storage means is a means to store electric energy, said power source may either a disposable battery or rechargeable battery pack (8), as described herein above. In case said energy storage means is a means to store kinetic energy, said power source may be a mechanical clockwork in combination with a power generator.

It is preferred that the jet-nozzle (5) or set of jet-nozzles, when present, the filter, when present, and the pumping means (10), when present, communicate with each other. This means that these different parts are interconnected with each other for example with flexible connectors (9), in order to allow the dispensing of the liquid through the pumping means (10) to the jet-nozzle (5) or set of jet-nozzles to move the devices in the vessel herein.

The devices (1) according to the different embodiments of the present invention herein may also be equipped with a reservoir or container for a cleaning composition. The cleaning composition reservoir preferably holds sufficient cleaning composition to allow the complete cleaning of the vessel to be cleaned in the process according to the present invention. In a preferred embodiment wherein the device (1) herein is used to clean a bathtub, the cleaning composition reservoir may hold up to 100 ml, preferably from 10 ml to 60 ml, more preferably from 15 ml to 40 ml, of cleaning composition. In a preferred embodiment wherein the device (1) herein is used to clean a liquid-containing vessel that holds significantly more water than a bathtub such as a swimming pool or a fuel tank and the like, the cleaning composition reservoir may hold up to 10 l, preferably from 500 ml to 6 l , of cleaning composition. The automatic cleaning devices (1) herein may be equipped with an inlet (3) to fill up the cleaning composition reservoir, when present.

It is preferred that the spray nozzle (2) or set of spray nozzles, when present, the cleaning composition reservoir, when present, and the pumping means (10), when present, communicate with each other. This means that these different parts are interconnected with each other for example with flexible connectors, in order to allow the dispensing of the cleaning composition in the cleaning composition reservoir through the pumping means (10) to the spray nozzle (2) or set of spray nozzles.

Furthermore, it is preferred that the spray nozzle (2) or set of spray nozzles, when present, the filter, when present, and the pumping means (10), when present, communicate with each other. This means that these different parts are interconnected with each other for example with flexible connectors, in order to allow the dispensing of the liquid through the pumping means (10) to the spray nozzle (2) or set of spray nozzles to rinse the inner surface of the vessel herein.

In the preferred embodiment herein, wherein the liquid-containing vessel is cleaned whilst it is being emptied and the inner surfaces of the vessel herein are rinsed with liquid present in the vessel, the process of cleaning herein ends after a final rinsing step. In order for the automatic cleaning device (1) to have sufficient levels of rinsing liquid left for the final rinsing step, the automatic cleaning device (1) may be equipped with a rinse-liquid storage reservoir. Preferably, said rinse-liquid storage reservoir is filled with rinse-liquid at a time when the vessel is not yet drained. More preferably, said rinse-liquid storage reservoir, when present, is interconnected with the spray nozzle (2) or set of spray nozzles, when present, the filter, when present, and the pumping means (10), when present, preferably by means of flexible connectors.

Preferably, the rinse-liquid reservoir holds sufficient rinse-liquid to allow the complete rinsing of the vessel to be cleaned in the process according to the present invention. In a preferred embodiment wherein the device (1) herein is used to clean a bathtub, the rinse-liquid reservoir may hold up to 1500 ml, preferably from 10 ml to 500 ml, more preferably from 15 ml to 200 ml, even more preferably 20 ml to 150 ml, still more preferably 50 ml to 150 ml, and most preferably 100 ml to 150 ml of rinse-liquid.

In a highly preferred embodiment herein, the liquid-containing vessel is drained during the process of cleaning and said process comprises: a first step wherein a cleaning composition is applied onto the inner surfaces of the liquid-containing vessel herein and/or the inner surfaces of said liquid-containing vessel are rinsed, and wherein preferably said cleaning composition and/or a rinse liquid are discharged through spray nozzles (2) mounted on a rotating spray head (4), which is not rotating, meaning it is fixed; and a second step wherein a cleaning composition is applied onto the bottom-surface of the liquid-containing vessel herein and/or the bottom-surface of said liquid-containing vessel is rinsed, herein preferably said cleaning composition and/or a rinse liquid are discharged through spray nozzles (2) mounted on a rotating spray head (4), which is rotating.

Cleaning Composition

The device (1) herein may apply a cleaning composition onto the surfaces of the liquid-containing vessels. Said cleaning composition may comprise conventional cleaning ingredients, in particular ingredients suitable to clean hard surfaces. Preferably, the composition herein may comprise compounds selected from the group consisting of surfactants, solvents, bleaches, stabilizing agents, chelating agents, builder systems, radical scavengers, perfumes, dyes, suds suppressing agents, photobleaching agents, and minors, and mixtures thereof.

Docking Station

The devices (1) herein may be combined in a kit together with a docking station. The docking station may be built in a way to be suitable as a storage device (1) for the automatic cleaning device (1) herein. Preferably, the docking station has a shape complementary to the shape of the cleaning device (1) or is in any other way suitable to hold and/or attach thereto the automatic cleaning device (1) herein.

In a preferred embodiment herein, the docking station is equipped with a device for recharging the rechargeable battery pack (8) of the automatic cleaning device (1), such as an electricity transformer and may therefore be connected to the main current. Preferably, the process of the rechargeable battery pack (8) of the automatic cleaning device (1) is performed automatically each time the automatic cleaning device (1) is placed on the docking station.

In another preferred embodiment herein, the docking station is equipped with a storage tank for the cleaning composition used in the process according to the present invention. It is in this preferred embodiment, wherein the cleaning composition reservoir of the automatic cleaning device (1) may be filled or refilled with cleaning composition from the storage tank for cleaning composition in the docking station, when the automatic cleaning device (1) is placed on the docking station. Preferably, the process of (re)filling the cleaning composition reservoir from the cleaning composition storage tank is performed automatically each time the automatic cleaning device (1) is placed on the docking station.

What is claimed is:

1. A floating device for cleaning a bathtub containing a liquid comprising water, said device comprising:

a inlet located at a bottom surface of said device;

pumping means for displacing a liquid wherein said pumping means is in fluid communication with said inlet;

a jet-nozzle in fluid communication with said pumping means such that the discharge of a liquid through said jet-nozzle causes said floating device to move on the surface of the liquid contained in said bathtub and wherein said liquid inlet and said jet-nozzle are below the surface level of the liquid contained in said bathtub;

a reservoir filled with a cleaning solution, wherein said reservoir is in fluid communication with said pumping means;

at least a spray nozzle for discharging said cleaning solution, wherein said spray nozzle is in fluid communication with said pumping means and wherein said spray nozzle is above the surface level of the liquid contained in said bathtub.

2. The floating device of claim 1 wherein said pumping means is battery operated.

3. The floating device of claim 1 further comprising a filter wherein said filter is fluidically connected to said inlet and said pumping means.

4. The floating device of claim 3 wherein said spray nozzle is connected to a rotating spray head.

5. The floating device of claim 4 wherein said rotating spray head rotates about a rotational axis when a liquid is discharged from said spray nozzle.

6. The floating device of claim 5 further comprising a self-tracking means.

* * * * *